US008418388B2

(12) United States Patent
Ferrarini et al.

(10) Patent No.: US 8,418,388 B2
(45) Date of Patent: Apr. 16, 2013

(54) DEVICE FOR COUNTING SHOTS FOR FIREARMS

(75) Inventors: Dario Ferrarini, Brescia (IT); Luigi Fioretti, Brescia (IT); Mauro Coccoli, Brescia (IT); Fausto Caravaggi, Brescia (IT)

(73) Assignee: Fabbrica d'Armi Pietro Beretta S.p.A., Gardone Val Trompia, Brescia (IT)

( * ) Notice: Subject to any disclaimer, the term of this patent is extended or adjusted under 35 U.S.C. 154(b) by 134 days.

(21) Appl. No.: 12/992,440

(22) PCT Filed: Jun. 23, 2009

(86) PCT No.: PCT/IB2009/052688

§ 371 (c)(1),
(2), (4) Date: Nov. 12, 2010

(87) PCT Pub. No.: WO2009/156944

PCT Pub. Date: Dec. 30, 2009

(65) Prior Publication Data

US 2011/0072703 A1 Mar. 31, 2011

(30) Foreign Application Priority Data

Jun. 27, 2008 (IT) ..... MI2008A1178

(51) Int. Cl.
*F41A 9/62* (2006.01)

(52) U.S. Cl.
USPC ..... 42/1.03

(58) Field of Classification Search ..... 42/1.01, 42/1.02, 1.03
See application file for complete search history.

(56) References Cited

U.S. PATENT DOCUMENTS

| | | | | |
|---|---|---|---|---|
| 6,941,693 | B2 * | 9/2005 | Rice et al. | 42/71.01 |
| 7,669,356 | B2 * | 3/2010 | Joannes et al. | 42/1.01 |
| 2005/0114084 | A1 | 5/2005 | Johnson et al. | |
| 2007/0144396 | A1 | 6/2007 | Hamel et al. | |
| 2008/0016744 | A1 | 1/2008 | Joannes et al. | |
| 2009/0211139 | A1 * | 8/2009 | Ufer et al. | 42/1.03 |
| 2010/0251586 | A1 * | 10/2010 | Packer et al. | 42/1.01 |

FOREIGN PATENT DOCUMENTS

| | | |
|---|---|---|
| DE | 3911804 | 10/1990 |
| DE | 102005011218 | 9/2005 |
| JP | 06066830 | 3/1994 |
| WO | 02/071078 | 9/2002 |

* cited by examiner

*Primary Examiner* — Stephen M Johnson
(74) *Attorney, Agent, or Firm* — Shoemaker and Mattare

(57) ABSTRACT

The invention relates to a device for counting shots (1) for a lightweight firearm (100). The device for counting shots includes a device (10) suitable to turn a part of the electrical signal connected to an acceleration applied to the firearm from an event. The device for counting shots also includes a processing unit (11) suitable to be fed by the electrical signal and suitable for analyzing the electrical signal itself.

9 Claims, 6 Drawing Sheets

DEVICE FOR COUNTING SHOTS FOR FIREARMS

The present invention is a device for counting shots, in particular a device for counting shots suitable for use on light firearms such as rifles, carbines and pistols.

Like any mechanical apparatus, light firearms must be subjected to maintenance cycles when predetermined wear conditions have been reached. Timely maintenance is of the utmost importance to ensure the both the safety of the user of the firearm as well those around him.

It is known that the wear to which light firearms or subjected depends on several factors such as exposure to weather and environmental conditions, the number and type of shots fired, and so on.

While some factors are easily verifiable, the number of shots fired results in a factor at the same time crucial and difficult to evaluate.

Devices for counting shots for small firearms are known, used mainly for statistical purposes during training sessions at the firing range. These devices for counting shots generally include a microprocessor and sensors suitable for monitoring some physical quantities: sound waves, infrared radiation, acceleration, shock waves, etc. The microprocessor and the sensor/s together are able to detect and record the firing of a round, through the evaluation of at least one of the physical quantities and/or at least one of their variations. These devices for counting shots are powered by a battery which guarantees the operation. It follows that the depletion, and/or the removal of the battery would compromise the operation of the device for counting shots and therefore stop the counting of the shots fired. Furthermore, the batteries are often designed to operate in rather limited temperature ranges, while the use of small firearms, such as hunting, may occur at temperatures outside these ranges.

The use of the weapon with the battery not functioning and therefore the entire device for counting shots, should therefore be carefully avoided. In fact, such use would result in the untimeliness of the maintenance operation on the firearm and therefore a decrease in the use safety.

The purpose of the present invention is to devise and make available a device for counting shots allowing at least to partially overcome the disadvantages pointed out above with reference to the prior art.

In particular, the purpose of the present invention is to provide a device for counting shots providing reliable and continuous the number of shots fired, in order to make a reliable assessment of the weapon's state to wear.

The said aim and purposes are achieved by a device for counting shots according to claim 1.

Further features and advantages of the device for counting shots according to the invention result from the following description of preferred non-limiting embodiments, with reference to the enclosed figures, wherein.

Figure 4:
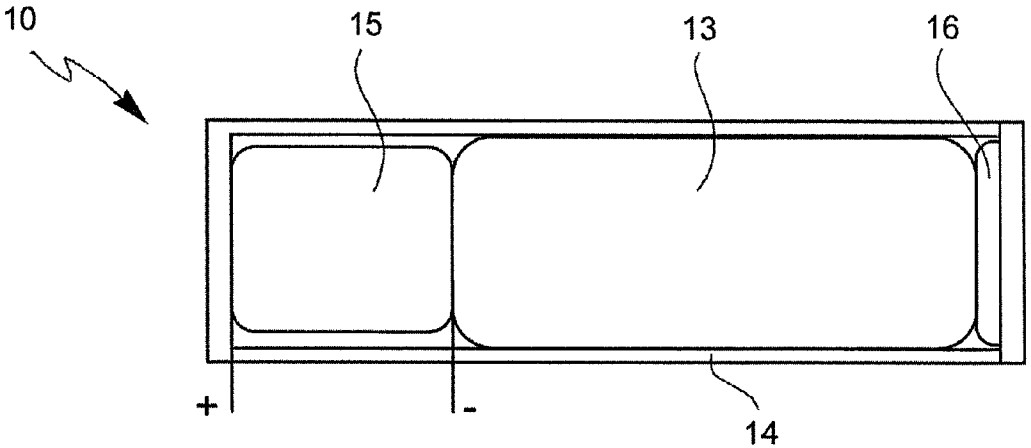
Figure 5:
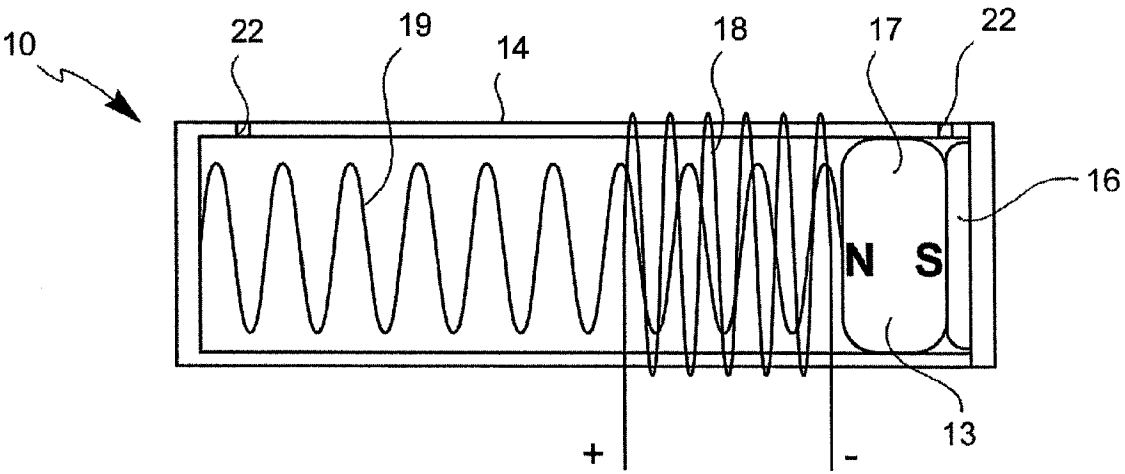
Figure 6:
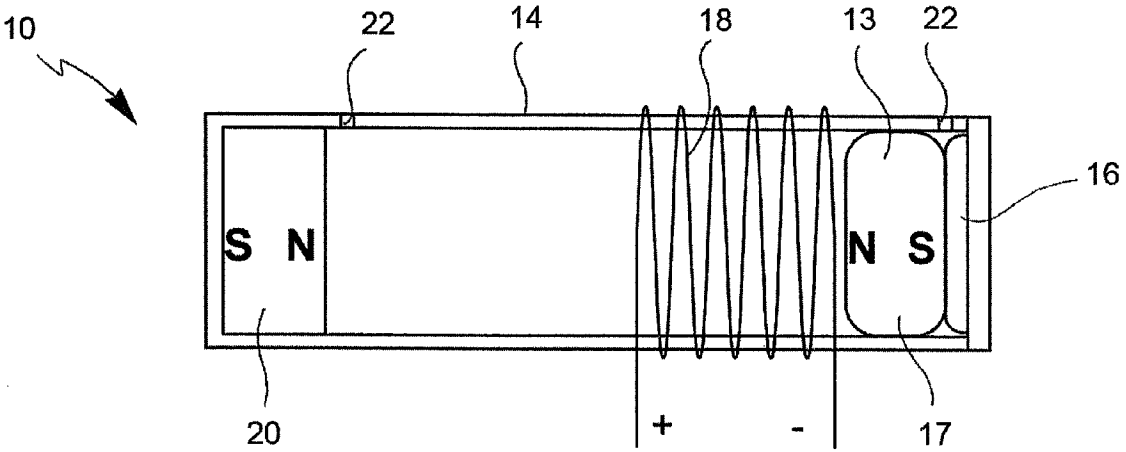
Figure 7:
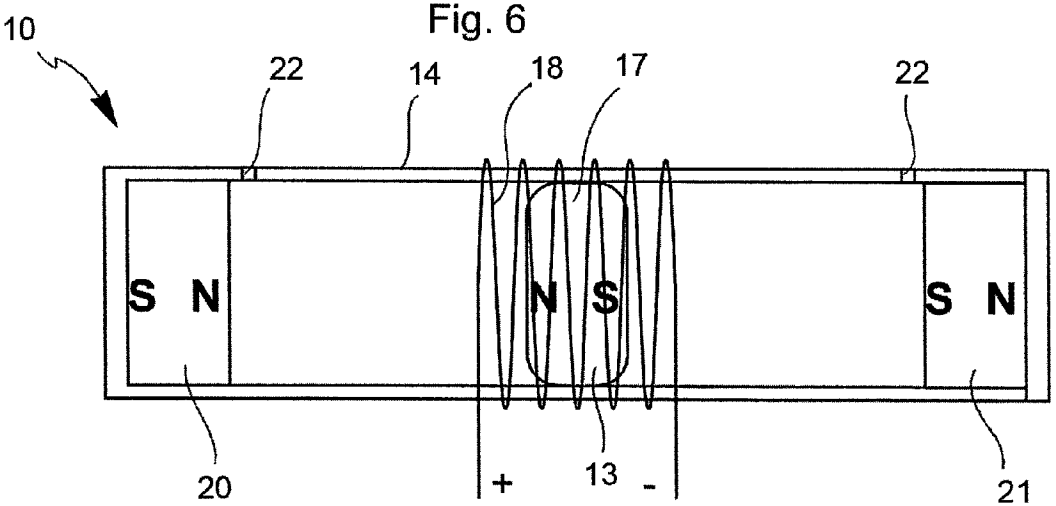
Figure 8:
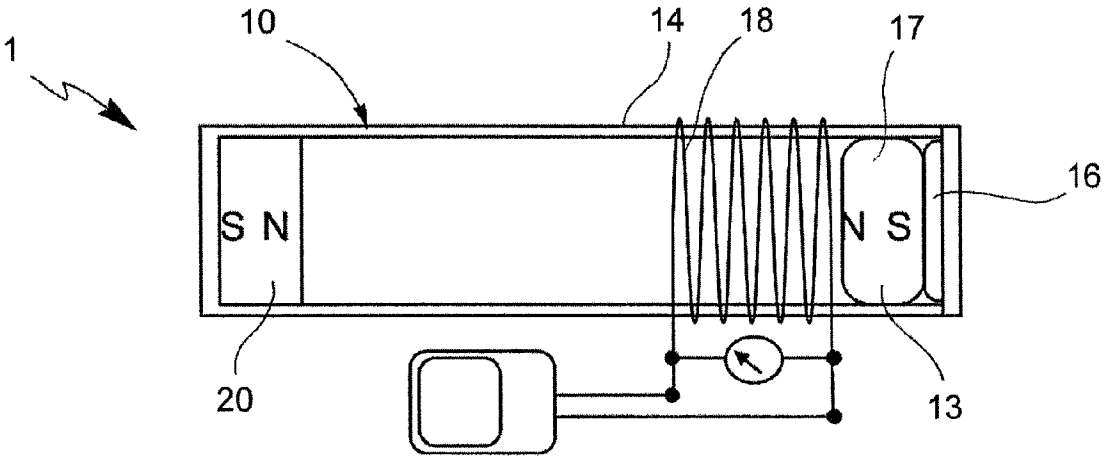
Figure 9:
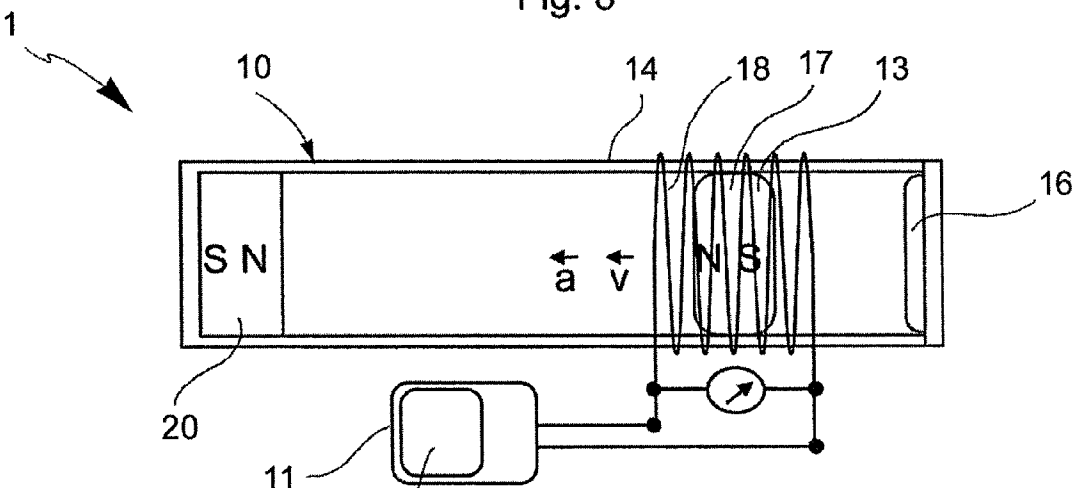
Figure 10:
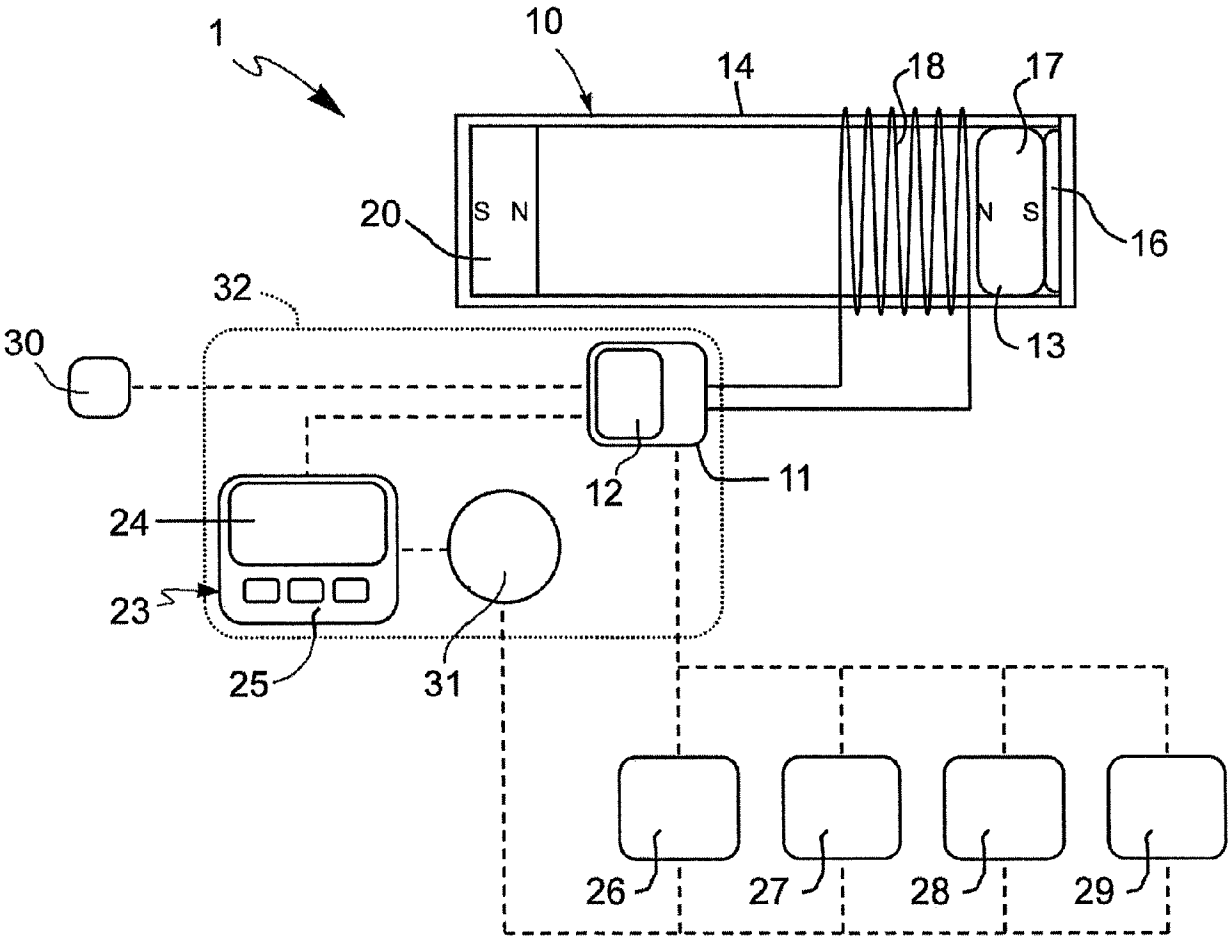
Figure 11:
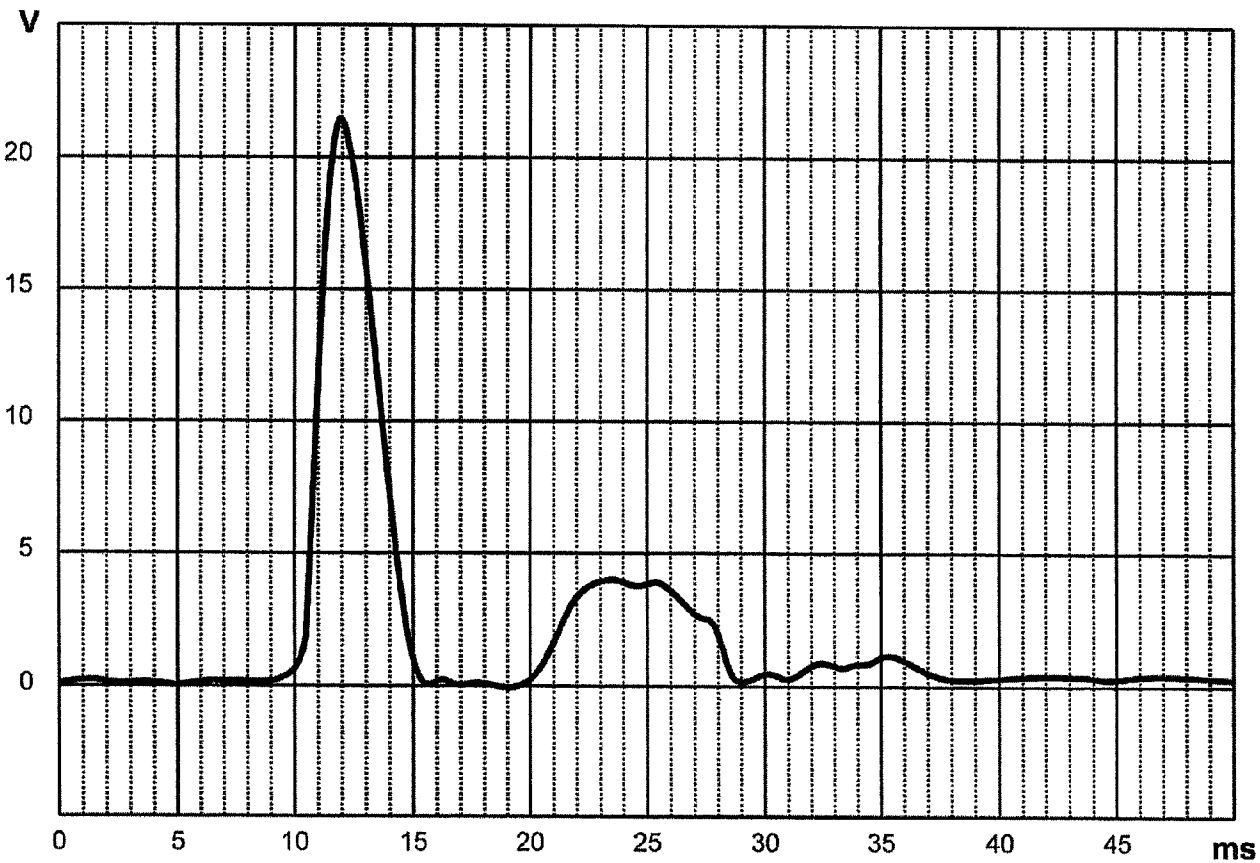

FIG. 4 schematically shows an embodiment of a device comprised in the apparatus according to the invention;

FIG. 5 schematically shows another embodiment of a device comprised in the apparatus according to the invention;

FIG. 6 schematically shows an embodiment of a device comprised in the apparatus according to the invention;

FIG. 7 schematically shows an embodiment of a device comprised in the apparatus according to the invention;

FIG. 8 schematically shows an apparatus according to the invention in a first operating condition;

FIG. 9 schematically shows the apparatus of FIG. 4 in a second operating condition;

FIG. 10 schematically shows an embodiment of an apparatus according to the invention;

FIG. 11 schematically shows a representative curve of the electrical signal generated by the device of FIGS. 4 to 9.

Figure 1:
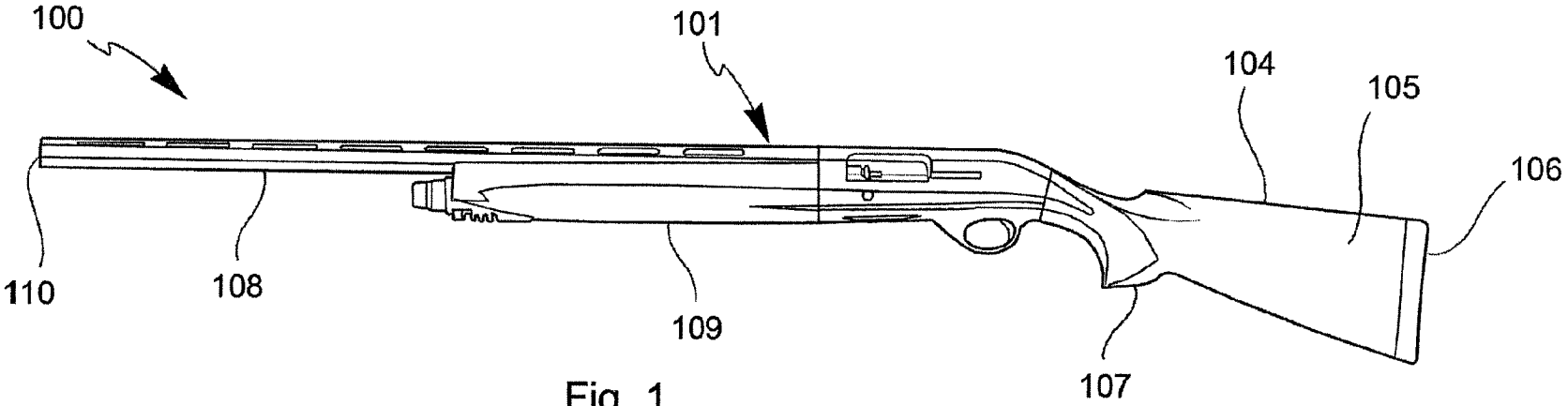
FIG. 1 shows an overall view of a firearm to which can be applied a device in accordance with the invention.
Figure 3:
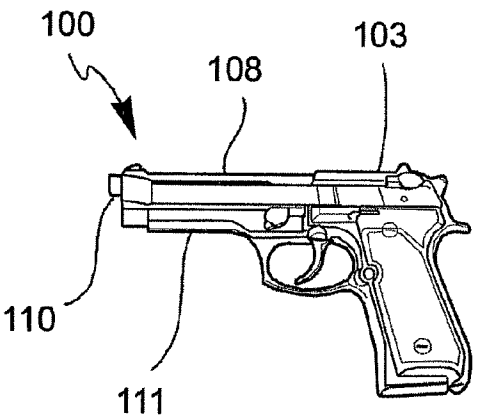
FIG. 3 shows an overall view of a further firearm to which can be applied a device in accordance with the invention.
Figure 2:
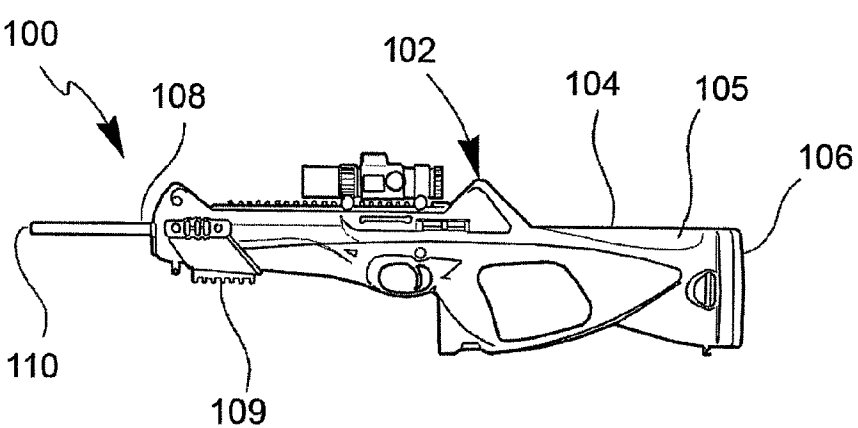
FIG. 2 shows an overall view of another firearm to which can be applied a device in accordance with the invention.

With reference to FIGS. 1 to 3, light firearms or individual firearms, on which the device for counting shots according to the invention can be applied, are indicated with reference 100. In the case of FIG. 1, the weapon 100 is a semiautomatic hunting rifle 101 but, without exiting from the invention, could be a different type of rifle, such as an over and under barrel or side-by-side barrel shotgun, a target rifle, a pump action shotgun or any other type of rifle.

In the case of FIG. 2, the weapon 100 is a BLOWBACK semiautomatic rifle 102 but, without exiting from the invention, could be a different type of rifle, such as a semiautomatic gas operated rifle, or a bolt action rifle or any other type of rifle.

In the case of FIG. 3, the weapon 100 is semiautomatic pistol 103 but, without exiting from the invention, could be a different type of pistol, such as a revolver or any other type of pistol.

The rifle 101 is in itself known and will not be described below in detail but only as it may be useful to the description of the invention. This includes a stock 104, comprising in turn of a butt 105, a butt plate 106 and a pistol grip 107. The gun 101 also includes a barrel 108 on top of a fore-end 109 that terminates in a muzzle 110.

Similarly the carbine 102, in itself known, includes a stock 104, comprising in turn of a butt 105 and a butt plate 106. The carbine 102 includes a barrel 108 on top of a fore-end 109 that terminates in a muzzle 110.

Similarly, the pistol 103, in itself known, also comprises a grip, a barrel 108 that overlaps a casing 111 that terminates in a muzzle 110.

With reference to FIGS. 4, 5 and 10 a device for counting shots 1 according to the invention will be described below. The device for counting shots 1 comprises a device 10 suitable to turn a part of the energy connected to an acceleration of the firearm 100 from an event, into an electrical signal. The device for counting shots 1 also includes a processing unit 11 suitable to be fed by the electrical signal generated by the device 10 and analyze the electrical signal itself. Advantageously, the processing unit 11 is able to record the event in a memory 12 organized to manage an incremental counter.

More specifically, the device 10 is able to generate an electrical signal by using the mechanical energy released at the time of shooting. The device 10 is therefore an electrical generator.

According to some embodiments, the device 10 uses the power that is generated as a result of the recoil acceleration on a specific mass 13. From here on we assume that the path and the direction of the shot are compatible with the orientation of the firearms shown in FIGS. 1 to 3. The firearm 100 therefore shoot from right to left. Therefore we assume that the recoil acceleration applied by the shot to the firearm 100 and device 10 is in the same path and in the opposite direction. It is therefore assumed in relation to all the figures attached that the acceleration due to the shot is applied to the firearm 100 from left to right. This dynamic situation can also be seen by a reference system secured to the firearm 100 and the housing 14. From here on this will be the reference system used to describe the operation of the invention.

Naturally these assumptions have been made with the sole purpose of simplifying the subsequent procedure, and nothing would change if a different hypothesis were made.

In accordance with some possible embodiments, schematically shown in FIG. 4, the force described above is exploited to compress the piezoelectric crystals. In particular, the mass 13 is received within a housing 14 in order to be able to move freely, even if imperceptibly. The housing 14 has connected to the firearm 100 and preferably parallel to the barrel 108 of the firearm 100. The mass 13 rests on its right against a stop 16, while to its left rests on plurality of piezoelectric crystals 15. The recoil imparted by firing the firearm 100 is transmitted directly into the housing 14 speeding from left to right. The inertia tends to keep the mass 13 in place before the recoil.

According to the reference system united to the firearm 100, it is the mass 13 that undergoes an acceleration from right to left due to the recoil. The acceleration to which the mass 13 is subjected, creates a compressive force on the piezoelectric crystals 15 which, in turn, gives rise to a potential difference between its extremes.

The potential difference created by the compression of the piezoelectric crystal is converted into an electrical signal intended to feed the processing unit 11 and processed by it.

In accordance with other possible embodiment, shown in FIGS. 5 to 9, the device 10 is a linear type electromagnetic induction generator. The mass 13 includes a permanent magnet 17 and the force described above is used to move it in relation to the winding of a coil 18. In particular, the mass 13 and the permanent magnet 17 are smoothly incorporated into a housing 14 in united to the firearm and preferably parallel to the barrel of the firearm 100. The mass 13 is flexible kept in a resting position from where it can move as a result of the recoil acceleration. The resting position of the mass 13 is that shown in FIGS. 5 to 8, while FIG. 9 shows the mass 13 during the movement caused by the acceleration.

Since the magnet 17 has a relatively high density, it can also act at the same time as a mass 13 because of its inertia characteristics. Therefore the mass 13 and/or magnet 17, will from hereon be indifferently referred to, without in any way intending that they are two different elements.

In accordance with the reference system united to the housing 14, the permanent magnet 17 undergoes an acceleration from right to left due to the recoil. The recoil acceleration then gives rise to the motion of the permanent magnet 17 through coil 18 in which, in turn, has induced an electric current.

The current induced in the coil 18 represents both the energy needed to power the processing unit 11 and the signal to be processed by the processing unit 11.

As can be noted, the embodiment of FIGS. 5, 6 and 7 adopt different solutions.

According to an embodiment, schematically shown in FIG. 5, the magnet 17 is maintained in the resting position by a spring 19 that drives the mass 13 against a stop 16 when the housing 14 is in a substantially horizontal position. The spring 19 must be made of a non-magnetic material and may for example be a cylindrical helix spring. This is sufficiently flexible to allow, as a result of the recoil acceleration, that the magnet 17 compresses it passing through the coil 18.

According to an embodiment, schematically shown in FIG. 6, the magnet 17 is maintained in the rest position by magnetic repulsion by a second magnet 20 united to the housing 14. The said repulsion is achieved by orientating the two magnets 17 and 20 in such a way that the faces of the same polarity (North with North or South with South) face one another. The magnetic repulsion is sufficiently strong to push the magnet 17 against the stop 16 when the housing 14 is in a substantially horizontal position. The rest condition is shown in FIGS. 6 and 8. At the same time, the magnetic repulsion is sufficiently flexible to allow, as a result of the recoil acceleration, the magnet 17 to pass through the coil 18. This condition of transient motion is schematically shown in FIG. 9.

According to an embodiment, schematically shown in FIG. 7, the magnet 17 is maintained in the rest position by the magnetic repulsion caused by two opposing magnets 20 and 21, both united to the housing 14. This repulsion is achieved by orientating the three magnets 17, 20 and 21 so that they oppose sides of the same polarity (North with North and South with South). The opposing magnetic repulsion retains the magnet 17 at the centre of the housing 14 when housing 14 is in a substantially horizontal position. The opposing magnetic repulsion is sufficiently flexible to allow, as a result of the recoil acceleration, the magnet 17 to pass through the coil 18.

In the description of the device 10 it has been said above that the housing 14 is united to the firearm and preferably parallel to the barrel. This means that the best configuration for the functioning of the device for counting shots 1 is one in which the axis of the housing 14 is perfectly parallel to the axis of the barrel 108. Within the confines of the invention other configurations are equally functional, in which the axis of the housing 14 is not perfectly parallel to the axis of the barrel but forms an angle within 5°. The said configurations can be adopted for different reasons. An angle can be imposed for logistic needs, for example to allow the housing of the device 10 in parts of the firearm already existing without changing its internal configuration and overall appearance. Other angles may be imposed if the device 10 is mounted in the butt 105 of the stock 104 the bend (angle in the plane of the butt) and the deviation (lateral angle) of which are adjustable by the user. Naturally in this case the neutral configuration can in principle provide a perfect parallelism between the axis of the housing 14 and the axis of the barrel 108, but in the personalised configuration for individual users such parallelism is generally abandoned.

According to some possible embodiments not represented in the attached figures, the magnet 17 may be maintained in the resting position by two opposing springs or a combination of a mechanical force operated by a spring and by, the magnetic repulsion operated by magnets.

According to some possible embodiments, the device 10 is made to ensure the operation even with the firearm 100 pointing downwards. In fact in this position the acceleration of gravity acts on the mass 13 altering the balance represented in FIGS. 5, 6 and 7. According to this embodiment, the position of the coil 18 along the housing 14, the mass 13 of the magnet 17 and the force (mechanical or magnetic) which holds the magnet 17 in place, are defined so that, with the firearm 100 pointed down, the magnet 17 is positioned near the far end of the coil 18. In fact this configuration makes it possible to maximize the change in magnetic flux through the coil 18 in spite that the position of the firearm 100 determines, at the time of shooting, a retreating movement between the magnet 17 and the coil 18.

According to an embodiment of the invention, the magnets 17, 20 and 21 are of the type neodymium-iron-boron (NdFeB) or samarium-cobalt (SmCo), or the like. These in fact should preferably maintain their performance in all environmental conditions in which the firearm 100 can operate. The magnets described above may retain their characteristics even at temperatures above 100° C., thus ensuring the reliability of the device 10 in all conditions.

As for the coil 18, it is noted that the representation given in the attached figure is purely schematic and does not describe neither the actual number of coils, nor the mutual arrangement of coils, or the actual diameter of the wire. These parameters must be determined so that the variation of the magnetic field due to the motion of the magnet 17 generates a current sufficient for their intended purpose. A coil suitable for the purposes can for example comprise 2000 turns of AWG38 wire (American Wire Gauge), having a section of about 0.008 mm2 and a diameter of 0.1 mm.

According to an embodiment, the housing 14 includes at least one vent 22 which allows to compensate for the differences in pressure generated by the movement of the magnet 17 inside the housing 14. The attached figures represent two vents 22 arranged near the end of the housing 14. Other possible solutions could include a slot that runs the entire length of the housing 14 or a single vent through the magnet 17.

According to an embodiment, the housing 14 in turn is covered by an outer shell (not represented for clarity) that guarantees its isolation from environmental contaminants such as water, dust, sand, etc. The access of these contaminants within the housing 14 could hinder or prevent the movement of the magnet 17, thus altering the functioning of the device 10.

According to an embodiment, the inner wall of the housing 14 and/or the outer surface of the mass 13 include means to reduce friction. Such means may for example be a lubricant film or a coating made of materials with low coefficient of friction such as polytetrafluoroethylene (PTFE).

As mentioned above, the device for counting shots 1 also includes a processing unit 11. This is suitable to be fed by the electrical signal generated by the device 10 and analyze the electrical signal itself. According to some embodiments the processing unit 11 includes a CPU (Central Processing Unit) which, depending on the specific need, may include one or more microprocessors and/or a DSP (Digital Signal Processor).

Moreover, the processing unit 11 is also suitable to record the event in a memory 12 organized to manage an incremental counter. The memory 12 is suitable to maintain information over time even without power. For example, it may contain some information necessary for the processing unit 11, some information for the identification of the device for counting shots 1 and/or some information for the identification of the firearm 100 (the serial number for example).

According to some embodiments, memory 12 may be, depending on the specific needs, an EPROM type (Erasable and Programmable Read Only Memory), EEPROM type (Electrically Erasable and Programmable Read Only Memory), flash type, or the like.

More specifically, the processing unit 11 is suitable to activate upon receiving the electrical signal generated by the device 10 in one of the ways described above.

The processing unit 11 is also suitable for acquiring parameters of the electrical signal, for example by sampling the values with a predetermined frequency.

The processing unit 11 is then able to compare the parameters obtained with the default values, so as to classify the event that generated the electric signal. If the acquired parameters satisfy predetermined relationships with the default values, the processing unit 11 is able to record the event in memory 12.

This is necessary to properly count the shots actually fired, without counting other events that cause the device 10 to generate an electrical signal. As was described above, the device 10 will be clear to the expert how it generates an electrical signal as a result of several events other than the shot. Any shaking, impact or sudden movement of the firearm can in general cause a relative acceleration between the mass 13 and the housing 14.

During the study and development of the device for counting shots 1, several types of output signal from the device 10 have been studied and the fundamental characteristics of the signals generated by one shot have been identified. These characteristics are recognizable on the variation of all the parameters that may influence the effect of the shot on the device 10.

In the case of a semi-automatic hunting rifle 101, such parameters could include the mass of pellets fired, the quantity and the quality of the powder used, the angle between the horizon at the time of shooting, the force which the user applies with the shoulder against recoil, etc.

On the variation of these conditions, the device 10 mounted on a semi-automatic hunting rifle 101 generates a signal that is qualitatively recognizable and that is comparable to that shown in FIG. 11. The signal is represented in terms of voltage (volts) versus time (milliseconds). The numerical values that characterize the curve may change during a change of the conditions listed above, but the overall shape of the curve will be qualitatively similar to the one shown. This signal will be analyzed below as an example, without any limitative value of the invention. Other types of firearms (such as a carbine 102 or a pistol 103) can generate curves with different characteristics which are not analyzed here.

From the curve in FIG. 11 we can see that the signal generated by the device 10 following a shot fired includes a first main peak and a second secondary peak. The first peak reaches a maximum peak voltage the value of which can vary between about 5 and 30 Volts. The duration of the peak is between about 4 and 6 milliseconds within which the processing unit 11 must activate, analyze the signal and possibly record the event in the memory 12.

In view of this it will be evident to the skilled person how beneficial the use, as a processing unit 11, of a rapid activation and more efficient microprocessor would be. A family of chips that meet these requirements is for example marketed under the trade name MSP430 from Texas Instruments Incorporated, headquartered in Dallas, USA.

Returning to the signal of FIG. 11, the voltage corresponding to the first part of the ascending ramp of the peak (for example the voltage supplied in the first millisecond) is sufficient to enable the processing unit 11. Once activated, the processing unit 11 is programmed to sample the value of the voltage signal, for example every 50 microseconds.

The processing unit 11 processes the sampled values by running algorithms based for instance on the average and/or on the peak and compares the results with predefined intervals and available in the memory. If this comparison indicates that the signal falls within the intervals, the processing unit 11 considers that it was generated by a shot and records the event in an incremental counter in the memory 12. If the signal does not fall within the predefined intervals, the processing unit 11 considers that it has not been generated by one shot, but by another event such as strong shaking or a fall and does not record anything.

Considering again the signal of FIG. 11, it is noted that after the first peak there is a second, very different. The maximum voltage reached on the second peak is well below the absolute maximum reached with the first; in particular the relative maximum is equal to about one fourth of the absolute maximum. In view of this, the duration of the second pulse is about 8-9 milliseconds, more so than the first. Based on these and other considerations, the processing unit 11 correctly does not considered this second impulse. In fact this does not derived from a second shot fired in rapid sequence, but is the result of movement of the mobile masses rearming the semi-automatic rifle.

In order to distinguish the signals generated by shots compared to signals generated by other events the following should also be considered.

A rather frequent occurrence during hunting is the fall of the rifle 101 from the stock 104. The rifle 101 is often carried over the shoulder, with the muzzle 110 oriented upward and the butt plate 106 oriented toward the ground. From this position, the fall of the rifle 101 determines a collision of the butt plate on the ground and then a sudden acceleration on all the rifle 101. The acceleration has the opposite direction to the recoil acceleration.

Often, the soil is soft enough to dispel much of the fall energy. In this case, the signal generated by the device 10 has a low intensity and is easily recognizable as not resulting from a shot.

However, if the ground was hard the signal generated as a result of such a fall could be comparable to that generated by one shot. Similar considerations can be made for other events. For example, for the stresses which a carbine 102 undergoes when used, by the stock 105, as a battering ram to break down a door during police operations or the like.

However in this regard it can be seen that the devices 10 shown in FIGS. 4 to 6 are asymmetric. In other words, these devices have the acceleration given by the recoil as the preferential operating direction. In the case of an acceleration such as that described above which has a mark opposite to the recoil acceleration, the asymmetric devices generate a peak voltage much lower.

Of course, the asymmetry of the device 10 does not allow to distinguish a fall of the rifle 101 with reverse orientation, in which the muzzle 110 hits on a hard ground. However this fall is statistically less frequent and in addition to being more damaging to the firearm 100 a shot may be fired.

FIGS. 8 and 9 show the operation of the device for counting shots 1 according to the invention. The device 10, such as that described above with reference to FIG. 6, is connected to the processing unit 11. A voltmeter is also illustrated in the figure that is not included in the inventor but that clearly exemplifies the operation of the device. The acceleration a and velocity v shown in FIG. 9 are those of the magnet 17 relative to a reference system connected to the firearm 100.

FIG. 10 represents a possible embodiment of the device for counting shots 1 according to the invention, also including some accessories described below. The embodiment of FIG. 10 includes all the accessories, but each can be added or removed from the device separately from the others, depending on the specific technical or commercial needs. For this reason, the accessories are connected to the device for counting shots 1 by dashed lines.

According to a possible embodiment, the device for counting shots 1 also includes a user interface 23.

The user interface 23 in turn comprises means to display information produced by the processing unit 11, which may include, for example, a display 24. The display 24 may be a classic liquid crystal display or LCD (Liquid Crystal Display) that needs to be powered to display information, or may be a cholesteric bistable type that only requires power to update the information displayed but then maintains it visible indefinitely. The display may also be monochrome or colour, and in each of these versions can be backlit.

The user interface 23 also includes means to define which information should be displayed, for example it can include a keyboard 25. The keyboard 25 may be conventional or may be integrated into the display, on a so-called touch-screen.

In accordance with a possible embodiment, the device for counting shots 1 comprises at least one partial shot counter resettable by the user and suitable to keep count of the shots fired in a single hunt or firing session. This partial shot counter is not an optional extra but is obtained by means of the processing unit 11 function and is activated by using appropriate commands.

According to a possible embodiment, the device for counting shots 1 includes an indicator of a parameter related to the energy released by the shots fired by the firearm 100. This indicator is not an optional extra but is obtained by means of the processing unit 11 function. Through the analysis of the output signal from the device 10, the processing unit 11 may estimate a parameter indicative of the energy released during each shot fired. This type of indication may allow to estimate in more detail the wear of the firearm 100. For example, in the case of a hunting rifle 101, the use of cartridges of high weight (for example, of 3½" the so called supermagnum) naturally causes more intense wear than that due to the use of cartridges with low weight (for example, of 2¾" so called standards). This indicator can therefore provide additional data to determine the maintenance intervals of the rifle 101.

A further feature of the indicator is to display the indicative parameter of the energy released by the single shot fired. This allows the user to evaluate in practice the difference between the cartridges on the market, beyond that stated by the manufacturer.

According to a possible embodiment, the device for counting shots 1 also includes a pressure sensor 26, suitable to acquire atmospheric pressure data. Based on this data the functions of the barometer and the altimeter can be integrated into the device for counting shots 1.

According to a possible embodiment, the device for counting shots 1 also includes a clock 27. Through the clock 27 it is possible for example to record the date and time in the counter to which each shot was fired.

According to a possible embodiment, the device for counting shots 1 also includes a thermometer 28.

According to a possible embodiment, the device for counting shots 1 may also include any of the accessories that are commonly included in portable electronic devices such as watches or mobile phones.

According to a possible embodiment, the device for counting shots 1 also includes an interface 30 which allows it to communicate with a different electronic device, for example with another similar device for counting shots 1, with a personal computer with a handheld computer with a smart phone, with an external memory, and so forth.

The interface 30 may require a physical plug-socket connection, according to the standard USB for example. The interface 30 can also take advantage of wireless technology such as infrared, Bluetooth, Wi-Fi and the like.

According to a possible embodiment, the device for counting shots 1 includes a register suitable to take note of significant events for the operational life of the weapon, such as the maintenance performed by qualified technicians. This register is not an optional extra but is obtained by means of a processing unit 11 function and/or memory 12. This register is preferably protected by a special key, hardware or software, making it accessible only by authorized technicians and not the user.

The access by means of the interface 30 to the counter of shots fired, to the indicator of the parameter related to the energy, to the register, to the memory 12, etc., may allow an authorized maintenance centre to easily and consistently generate and update a card of a single firearm 100.

According to a possible embodiment, the device for counting shots 1 also includes a battery 31. As the skilled person can easily understand, the accessories listed and described above generally cannot be powered by the output signal from the device 10 and therefore require the presence of an independent power supply such as the battery 31. It should be noted here that the presence and charge status of the battery can only affect the operation of accessories, but not the operation of the device 10 and processing unit 11. In other words, in the absence of the battery 31, the number of shots fired will be indicated on the display 24, but the processing units 11 will continue to correctly count them and record them in the memory 12.

According to some possible embodiments of the invention, the device 10 is built to contain the weights and dimensions, so as not to upset the traditional balance of the firearm 100, for example, the rifle 101.

As an example a specific embodiment of the device for counting shots 1 is considered comprising: a device 10 of the type shown in FIG. 6, a processing unit 11 such as the Texas Instruments MSP430 series, a simple backlit LCD display 24, a keyboard 25 with three keys, and a CR2032 type (3V and 230 mAh) lithium battery 31. This embodiment has a limited total mass of approximately grams. It is evident to the skilled person how an additional mass of 50 grams does not substantially alter the balance of the firearm 101, which may plausibly have a mass between 2.5 and 4.5 Kg Regarding the size of the device, device 10 is the more cumbersome and measures about 55 mm in length and an outer diameter of 20 mm. The processing unit 11, the user interface 23 and battery 31 are advantageously mounted on a card 32 (shown in hatching in FIG. 10), which has an overall measurement of about 40×30 millimetres and 15 millimetres thick.

A simple wire connection may allow the device 10 to be detached from the card 32. Thus each component can be given an optimal location.

According to an embodiment of the invention applied to a rifle 101, the device 10 is housed in the butt 105 of the stock 104, while the card 32 is mounted in pistol grip 107.

According to a further embodiment, the device for counting shots 1 may find different locations, in the fore-end 109 for example, if there is not already the cartridges magazine and/or the mechanism for the semiautomatic loading of the firearm 100.

These considerations can also be considered valid for the application of the device for counting shots 1 to a carbine 102, which generally has a configuration and a total mass similar to that of the rifle 101.

However, with regard to the piston 103, the question of the mass and overall dimensions of the device for counting shots 1 becomes significantly more problematic. In fact the pistol 103 has a significantly lower total mass and does not generally have parts that can be utilised like the butt 105 of the stock 104. A device for counting shots 1 specifically scaled to be applied to a pistol 103 could for example be placed under the casing 111, before the trigger guard.

According to a further embodiment, the device for counting shots 1 may be produced as an independent accessory and suitable for application to a firearm 100 that has not been specifically designed to adopt it, in other words it can be produced and proposed as a so called after market accessory. The device for counting shots 1 for example may be enclosed in a suitable housing to be applied to a firearm 100. The application of the device for counting shots 1 to the firearm must take into account the need for a rigid attachment while using the firearm. This application may for example be by means of a standard Picatinny type guide or other specially designed attachments, or by other means such as fasteners, screws, rivets, glue, ties or similar.

According to an embodiment, the device for counting shots 1 satisfies the same operation conditions required by the firearm 100 on which it is mounted in terms of temperature, humidity, shock, etc.

According to an embodiment, the device for counting shots 1 comprises an access protected by a special key, which can be either hardware or software. Through this access, if needed, the qualified operators can inspect, upgrade, re-program the device 1 and also reset the counter.

In light of the description above, it will be evident to the skilled person that the device for counting shots 1 according to the invention, is a reliable indicator of the state to wear of the firearm 100.

In particular, the device for counting shots 1, basing its operation on the phenomenon of recoil, is suitable for any type of firearm 100. Being that the device for counting shots 1 is not dependent on power supplied by the battery 31, it cannot be deactivated, either inadvertently or deliberately, by the user.

The device for counting shots 1 therefore represents for the firearm 100 that which the odometer represents for a car.

To the embodiment of the device for counting shots described above, a man skilled in the art may make changes, adjustments and replacements of parts with other equivalent functionally in order to meet specific and incidental needs, all falling within the scope defined in the following claims. Each of the characteristics described as belonging to a possible embodiment can be achieved independently from other embodiments described.

The invention claimed is:

1. A counting device for counting shots for a light firearm, comprising:

a converting device to transform into an electric signal part of the energy linked to an acceleration of a mass in the converting device applied to the firearm by an event; and a processing unit having a memory, said processing unit being powered by the electric signal and suitable to analyze said electric signal, and suitable to record the event in said memory, wherein the processing unit is activated by the electrical signal generated by the converting device and the converting device also comprises a plurality of piezoelectric crystals, wherein the power that is generated on the mass due to acceleration, is used to compress the plurality of piezoelectric crystals.

2. Counting device according to claim 1, wherein the processing unit is also suitable for acquiring parameters of said electrical signal.

3. Counting device according to claim 1, wherein the processing unit is suitable to compare the parameters of the electrical signal with the default values, so as to classify the event that generated the electric signal.

4. Counting device according to claim 1, wherein the processing unit is able, if the parameters of the electrical signal acquired meet predetermined relationship with the default values, to record the event in a memory.

5. Counting device according to claim 1, further comprising a user interface.

6. Counting device according to claim 1, comprising an indicator of a parameter related to the energy released by the shots fired.

7. Lightweight firearm comprising a device for counting shots in accordance with claim 1.

8. A counting device for counting shots for a light firearm, comprising:

a converting device to transform into an electric signal part of the energy linked to an acceleration of a mass in the converting device applied to the firearm by an event; and a processing unit having a memory, said processing unit being powered by the electric signal and suitable to analyze said electric signal, and suitable to record the event in said memory, wherein the processing unit is activated by the electrical signal generated by the converting device, and the processing unit is suitable to activate, analyze the electrical signal and eventually record the event in a memory in a time interval of between 4 and 6 milliseconds.

9. A counting device for counting shots for a light firearm, comprising:

a converting device to transform into an electric signal part of the energy linked to an acceleration of a mass in the converting device applied to the firearm by an event; and a processing unit having a memory, said processing unit being powered by the electric signal and suitable to analyze said electric signal, and suitable to record the event in said memory, wherein the processing unit is activated by the electrical signal generated by the converting device, the converting device is a linear type electromagnetic induction generator and wherein the converting device includes a coil, and the mass comprises a permanent magnet and is smoothly housed in the housing and the converting device further comprises at least one second magnet connected to the housing, the permanent magnet and the second magnet having opposed magnetic orientation, thus generating a magnetic repulsion.

* * * * *